US008127821B2

(12) United States Patent
Hsu et al.

(10) Patent No.: US 8,127,821 B2
(45) Date of Patent: Mar. 6, 2012

(54) ROMAN SHADE WINDOW CURTAIN HAVING ROLLING SPOOL FOR MULTI-STEP RETRACTING/UNFOLDING CONTROL

(75) Inventors: Kai-Sheng Hsu, Yorba Linda, CA (US); Chih Yung Wang, Taipei (TW)

(73) Assignee: Pacific Heritage Home Fashions Inc., Walnut, CA (US)

( * ) Notice: Subject to any disclaimer, the term of this patent is extended or adjusted under 35 U.S.C. 154(b) by 0 days.

(21) Appl. No.: 13/006,669

(22) Filed: Jan. 14, 2011

(65) Prior Publication Data

US 2011/0108206 A1 May 12, 2011

Related U.S. Application Data

(63) Continuation-in-part of application No. 12/564,806, filed on Sep. 22, 2009.

(51) Int. Cl.
*E06B 3/48* (2006.01)

(52) U.S. Cl. ..... 160/84.01; 160/89; 160/108; 160/120; 160/DIG. 15

(58) Field of Classification Search ..... 160/84.01, 160/84.02, 89, 108, 263, DIG. 15, 120
See application file for complete search history.

(56) References Cited

U.S. PATENT DOCUMENTS

| | | | | | |
|---|---|---|---|---|---|
| 98,601 | A * | 1/1870 | Kinball et al. | ..... | 160/28 |
| 305,370 | A * | 9/1884 | Benedict | ..... | 160/120 |
| 515,218 | A * | 2/1894 | Hartshorn | ..... | 160/263 |
| 806,427 | A * | 12/1905 | Record | ..... | 160/263 |
| 808,695 | A * | 1/1906 | Smith et al. | ..... | 160/28 |
| 813,642 | A * | 2/1906 | Gilland et al. | ..... | 160/121.1 |
| 3,777,800 | A * | 12/1973 | Susoev | ..... | 160/84.04 |
| 4,006,770 | A * | 2/1977 | Ferguson | ..... | 160/263 |
| 5,566,735 | A * | 10/1996 | Jelic | ..... | 160/84.04 |
| 5,690,156 | A * | 11/1997 | Ruggles | ..... | 160/84.04 |
| 6,257,300 | B1 * | 7/2001 | Brownlie | ..... | 160/84.01 |
| 6,460,593 | B1 * | 10/2002 | Floyd | ..... | 160/370.22 |
| 6,817,399 | B2 * | 11/2004 | Berman et al. | ..... | 160/84.04 |
| 7,124,802 | B2 * | 10/2006 | Sudano | ..... | 160/89 |
| 7,624,784 | B2 * | 12/2009 | Anthony et al. | ..... | 160/120 |
| 2005/0087309 | A1 * | 4/2005 | Nien et al. | ..... | 160/120 |
| 2008/0110582 | A1 * | 5/2008 | Rasmussen | ..... | 160/263 |
| 2010/0269985 | A1 * | 10/2010 | Hanley et al. | ..... | 160/84.04 |
| 2011/0067820 | A1 * | 3/2011 | Hsu et al. | ..... | 160/84.03 |
| 2011/0146918 | A1 * | 6/2011 | Vestal | ..... | 160/84.06 |
| 2011/0247761 | A1 * | 10/2011 | Lin | ..... | 160/84.02 |

* cited by examiner

*Primary Examiner* — Blair M Johnson
*Assistant Examiner* — Johnnie A Shablack
(74) *Attorney, Agent, or Firm* — Jen-Feng Lee

(57) ABSTRACT

Present invention teaches to make a Roman shade window curtain where a sliding locking mechanism is provided at the bottom beam of the rolling spool at the back side of the Roman shade, where the engaging positions between the rolling spool bottom beam and the pair of auxiliary rods can be set according to user preference, by sliding the locking tubes towards the middle to move the engaging point up and down, and by sliding the licking tubes to the left and right extremities for engaging the bottom to the desired fold line on the Roman shade.

4 Claims, 8 Drawing Sheets

ROMAN SHADE WINDOW CURTAIN HAVING ROLLING SPOOL FOR MULTI-STEP RETRACTING/UNFOLDING CONTROL

The present application is a Continuation-In-Part of an earlier application Ser. No. 12/564,806, filing date Sep. 22, 2009, by the same inventors, and incorporate the prior disclosure of the earlier application, with additional disclosure of new matters introduced and claimed herein.

FIELD AND BACKGROUND OF THE INVENTION

The present invention relates generally to window curtain containing Roman shade, using a controllable refraction device for up-down release/retract of the Roman shade.

Window curtains are made for functional usages of blocking sunlight, or creating privacy space, and for decorative purpose of adding visual attractiveness to households. Depending on consumer likings and preferences, quite a number of styles and variation of window curtains/shades are commercially available. Traditional fabric curtains, plastic or wood mini-blinds, Roman shades, vertical blinds, etc, are all the commonly seen choices.

Present invention provides a roller-shade based Roman shade, where the pull-up and extend-down setting between the front surface (the fold-accordion side of the Roman shade) and the rolling spool screen can have different steps, resulting in the "opaqueness" of the complete curtain to be within consumer's control.

The multi-step engagement mechanism of present application can be applied to either a fix-string type traditional Roman shade, or a more modern "cordless" type of Roman shade with a roller spool serving as the pull-down and retracting-up control.

The description of present invention is based upon a "cordless" type Roman shade having a roller spool in the back side. However, it should be understood that the traditional "corded" type Roman shade can equally benefit from the multi-step construction of present application.

OBJECTS AND SUMMARY OF THE INVENTION

Present invention teaches to make a Roman shade window curtain where a retraction device (a rolling spool) is used at the back side to retract/unfold the shade, and there are multiple places of engagement between the bottom point of the rolling spool screen and the front fabric.

As such, consumers have the choice of controlling the total thickness of a window curtain, by setting the different bottom position of the roller spool screen relative to the front fabric screen, creating a user-oriented "day-and-night" selections, where the bottom position is engaged to the bottom portion of the front Roman shade fabric, very least amount of light would be allowed, whereas if the bottom position of the rolling spool screen is engaged to the upper portion of the front Roman shade fabric, the overall opaqueness of the window shade will be reduced and allowing more light to come in.

The description of present invention is based upon a "cordless" type Roman shade having a roller spool in the back side. However, it should be understood that the traditional "corded" type Roman shade can equally benefit from the multi-step construction of present application. And the disclosure and claimed scope of present application is thus not limited to the "cordless" construction.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 1:
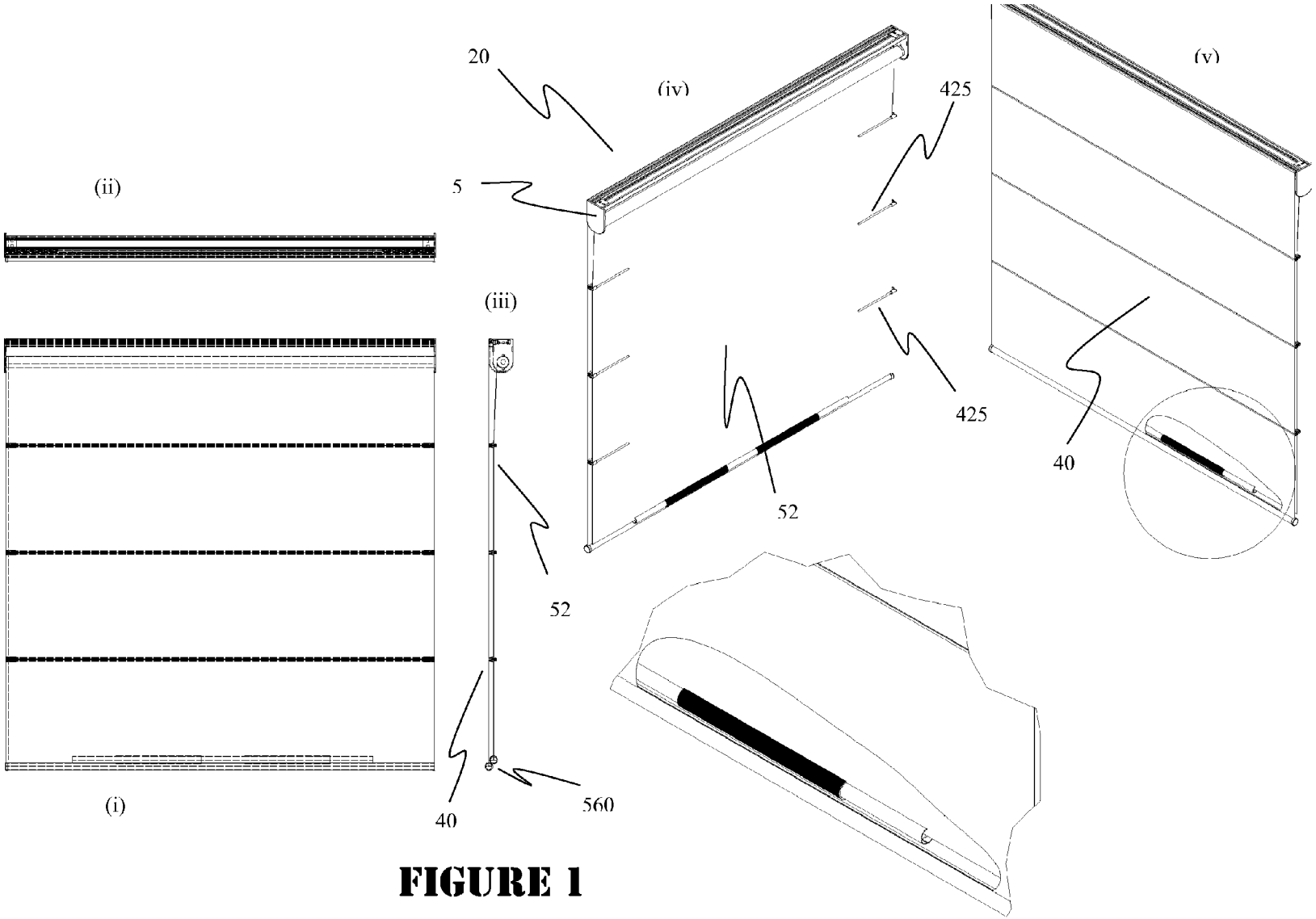
FIG. 1 shows an overall operation view of the sliding and locking mechanism, when the two sliding tubes are not placed towards the two sides, allowing the rolling spool to travel up and down, until a desired point is reached where the sliding tubes can be moved to two sides and to engage the bottom beam to the desired vertical points on the Roman shade fabric.

As shown herein, the Roman curtain 20 of present invention consists primarily of a front side Roman shade 40 (i.e. the shade made to have a accordion wavy style that people see) and a back side rolling spool screen 52.

Said rolling spool screen 52 can be extended down from and be retracted back up into a rolling spool 50 which is located inside a head rail, or mounted to the head rail in the event that a piece of wood or other material is used as a head rail to reduce cost. The rolling spool 50 and the connection of the Roman shade along with the rolling spool screen to the head rail is disclosed in the inventor's prior disclosure, other than helping to explain the novelty points of present application, do not form the claimed invention of present application and need no further disclosure herein.

Front side Roman shade 40 forms the resulting wavy Roman shade where the fold lines serve as the places for the "waves" to be formed, when the curtain 20 is pulled up.

Each fold line is shown by a position-delineating device 42 where a delineating rod 421 clips a horizontal segment of the shade 40 into a horizontal fold line, which is then attached to a corresponding auxiliary rod 425 by a double-pronged hook 422.

Figure 3:
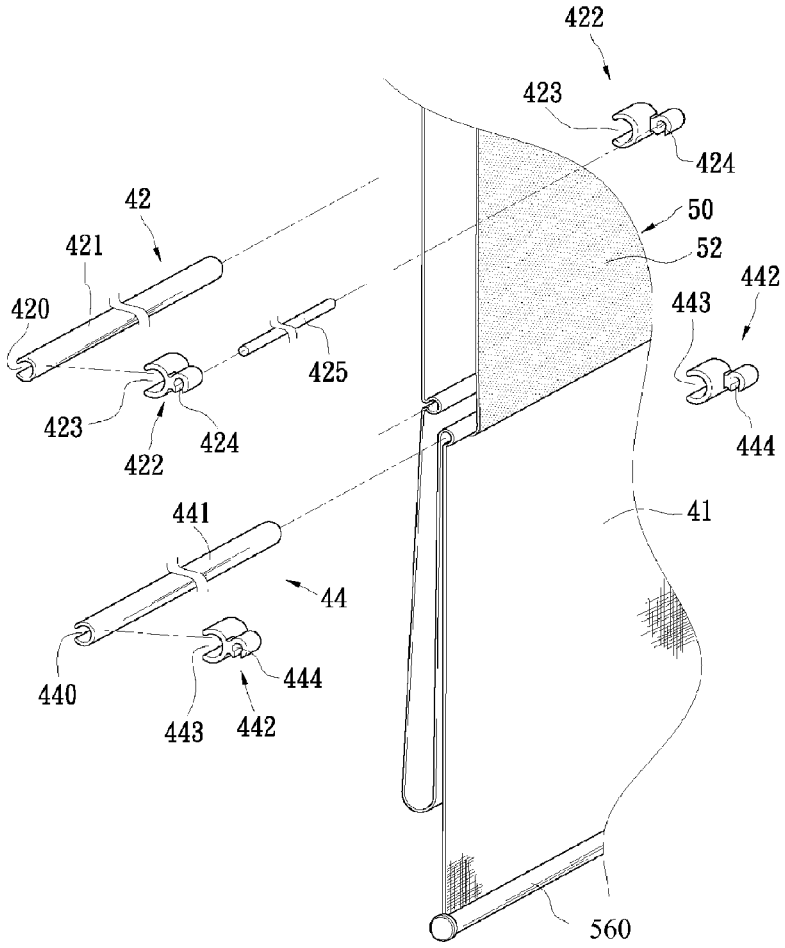
FIG. 3 shows the connection between the Roman shade (the accordion wavy formation on the front fabric) and the rolling spool curtain, where the rolling spool curtain can move up and down in the gap created between the auxiliary rod and the delineating rod at each of the fold lines.
Figure 4:
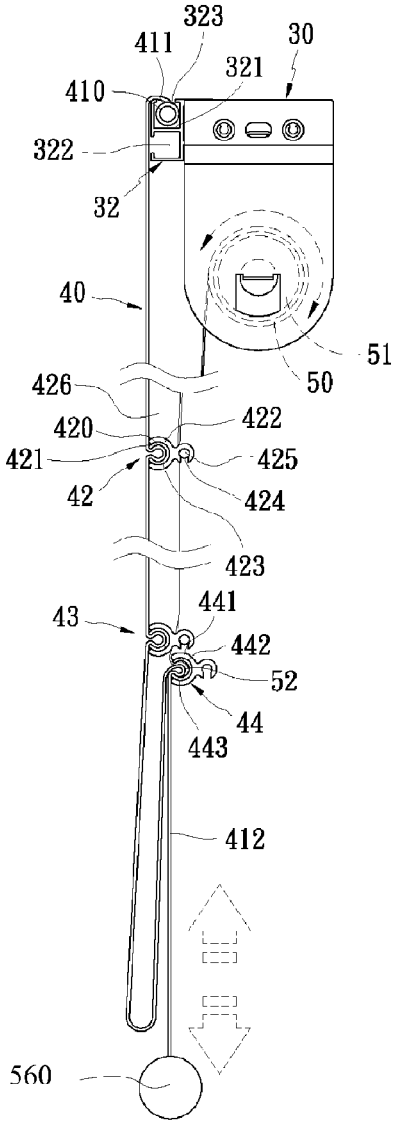
FIG. 4 provides a side view of the rolling spool curtain engaged to the front Roman shade fabric.

See FIG. 3 for the structural implementation of the horizontal fold line formed on the Roman shade surface.

Auxiliary rod 425 does not go the full length from one side of the curtain 20 to the other side. Only partial length is needed for auxiliary rod 425 to serve as an "engaging" point for the sliding tube 565 (explained later) to get wedged to. The middle portion along the horizontal linear direction of the pair of auxiliary rod 425 provides for the room to allow the bottom beam 560 to go up and down as user desired, for purpose of setting the desired thickness (combining 2 layers of fabric from the Roman shade in the front and the rolling spool screen in the back) of a window curtain A horizontal trough 420 is formed on said position-delineating rod 421, for receiving a small portion of fabric curtain 41 and getting that small horizontal stretch of the fabric curtain 41 tucked into the trough 420. Said double-pronged hook 422 has a first open trough 423 and second open trough 424, located opposite of each other, so that when they are used at the two ends (left and right ends) of delineating rod 421, with the first open trough 423 clamping to the delineating rod 421.

The pair of second open troughs 424 (on the double-pronged hooks 422) similarly clamp the auxiliary rod 425, forming a gap 426 (between auxiliary rod 425 and delineating rod 421) allowing rolling spool screen 52 to travel up and down as desired.

On FIG. 3, the same mechanical structure for a second (and lower) fold line of delineating device 44, with parts number of 441, 442, 443 and 444, etc., work in the same way as the 42 delineating device and requires no more disclosure herein.

Auxiliary rod 425 is a partial length rigid structure that goes from the two sides of the curtain 20 towards the middle, as shown in the figures. As such, the rolling spool screen 52 is placed inside the gap 426 created between the delineating rod 421 and auxiliary rod 425, while the auxiliary rod 425 is connected to the delineating rod 421 by the two double-pronged hook 422 on the two sides of the curtain 20.

The front shade 40 has its top affixed to a horizontal head rail 5, so that the fabric 41 would naturally drape down.

Inside head rail 5, there is a rolling spool 50, used to provide the up-down movements of the rolling spool screen 52.

A bottom beam 560 horizontally forms the low-end of said rolling spool screen 52.

Figure 5:
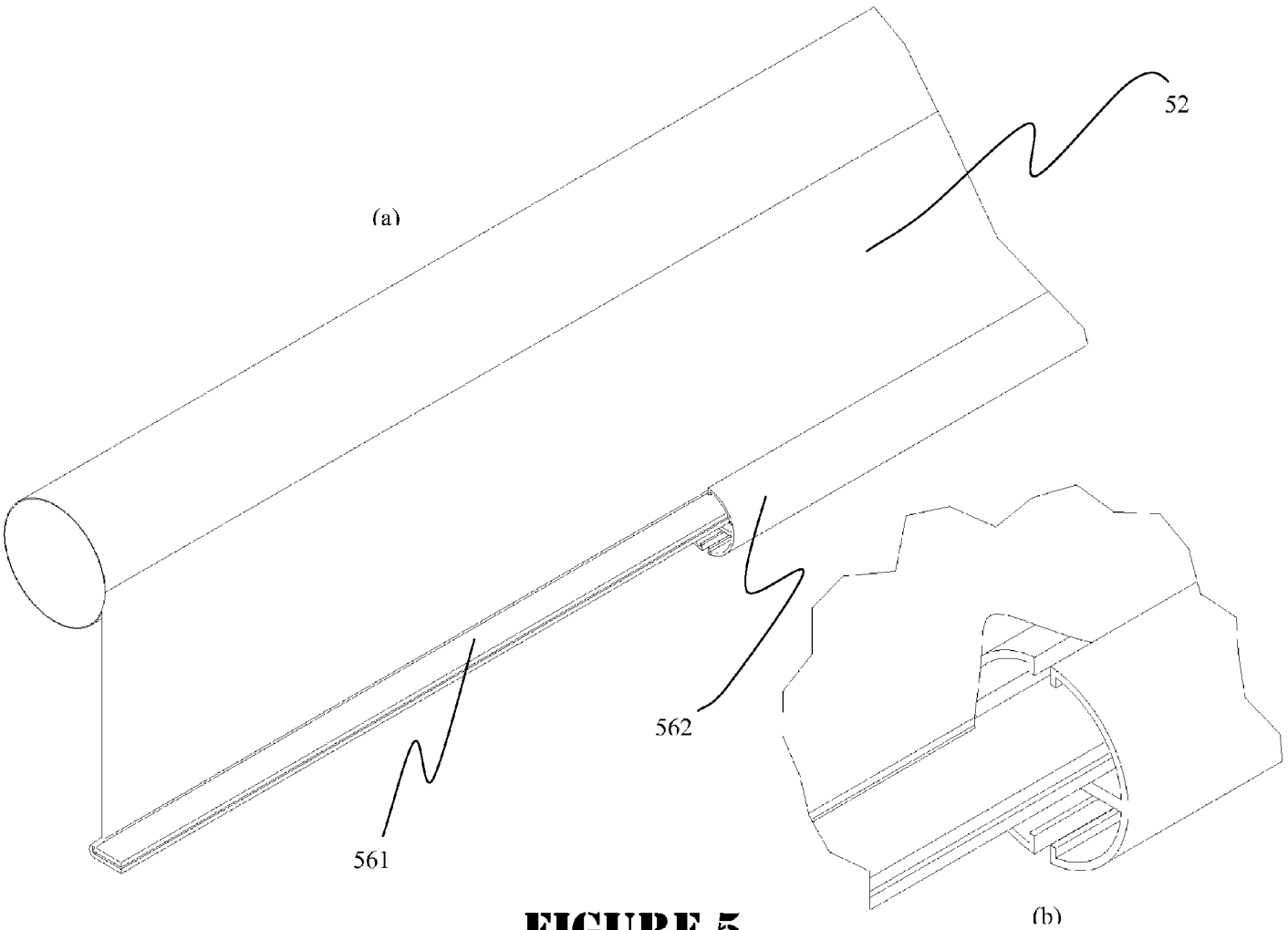
FIG. 5 shows the structure of bottom beam, where the rigid piece is wrapped inside a round tube.
Figure 6:
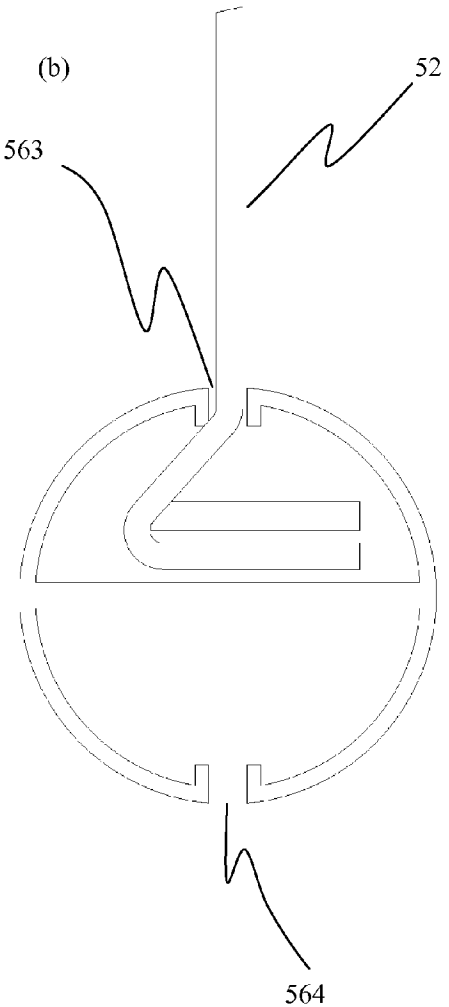
FIG. 6 shows the detailed structure of the bottom beam, with side view shown in FIG. 6*b*.
Figure 6:
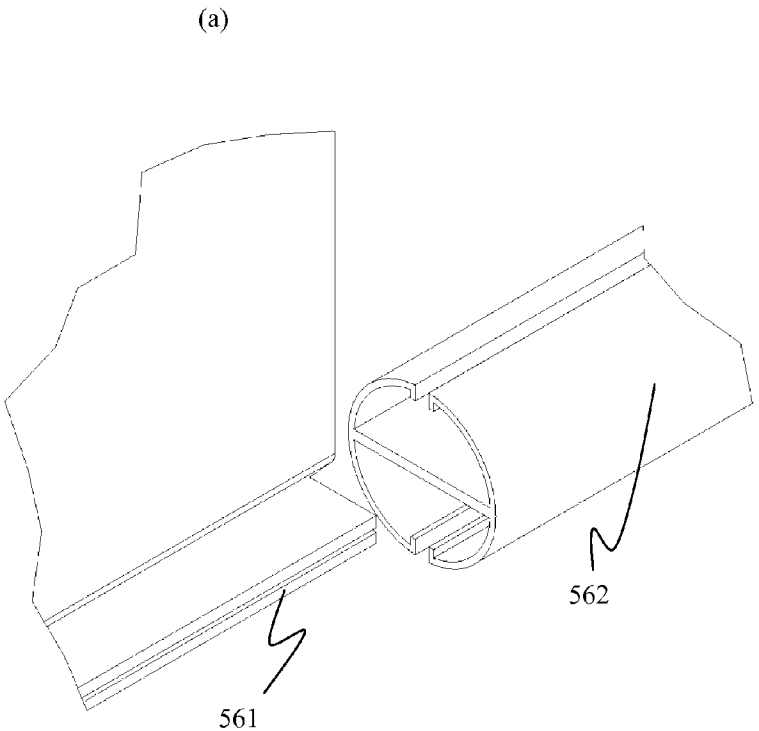
Figure 7:
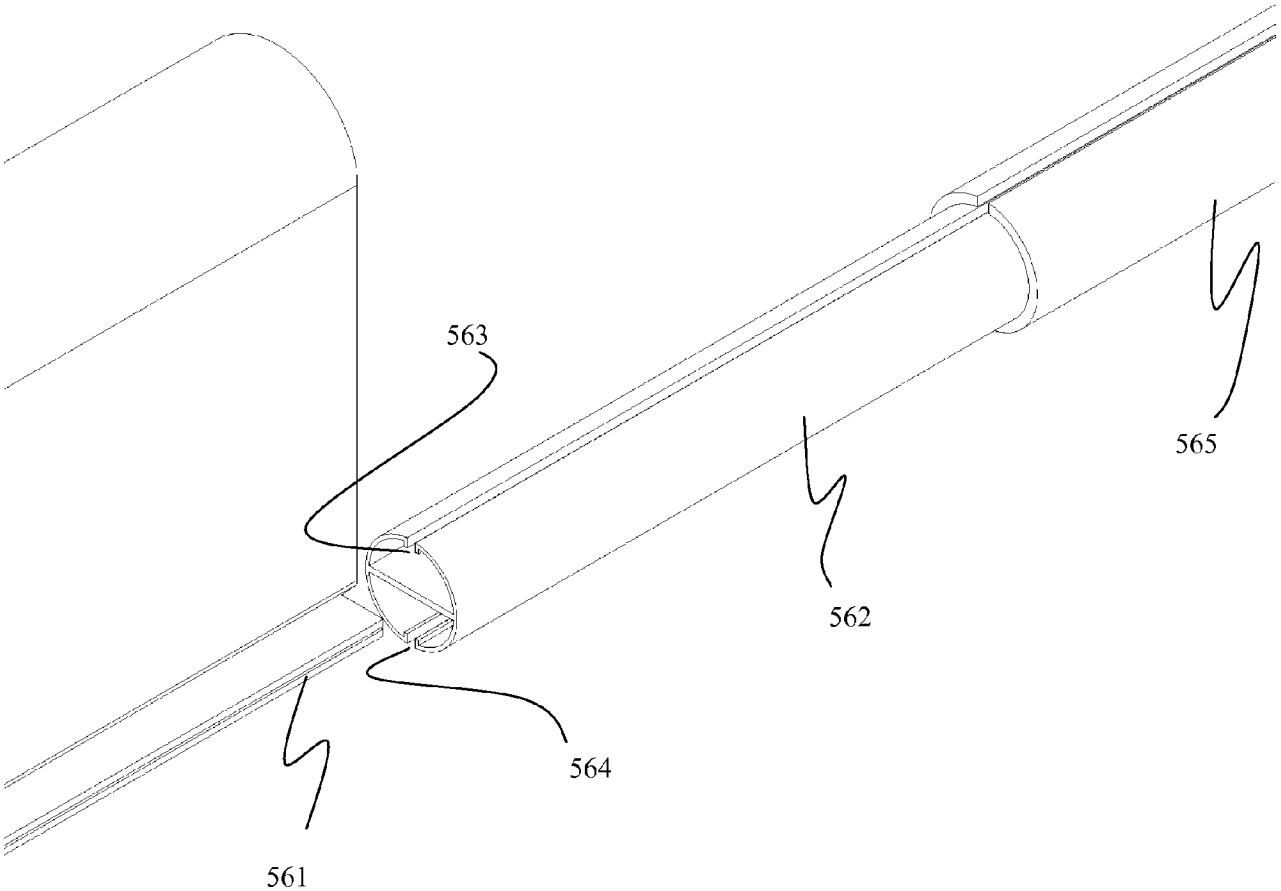
FIG. 7 shows the assembly parts of rigid piece, round tube and sliding tube.

Referring to FIGS. 5 and 6, the bottom beam 560 is made up of a horizontal rigid tab piece 561 and a round tube 562 with a top opening 563 to accommodate the connection from the rigid tab piece 561 to the lower end of the rolling spool screen 52.

The external diameter size of the bottom beam 560 will be such that it is slightly smaller than the gap 426 formed between auxiliary rod 425 and delineating rod 421, allowing bottom beam 560 to travel through the gap 426 (unless the sliding tubes 565 are pushed to two sides) up and down, for purpose of choosing the desired point of engaging the bottom beam 560 to a selected fold line of the Roman shade 40.

Said rigid piece 561, when viewed from the side, appeared to have a semi-hook structure, as shown in FIG. 6*b*. The round tube 562, as shown in FIG. 6*b*, has a bottom opening 564, for purpose of receiving a sliding tube 565, as explained later.

Figure 2:
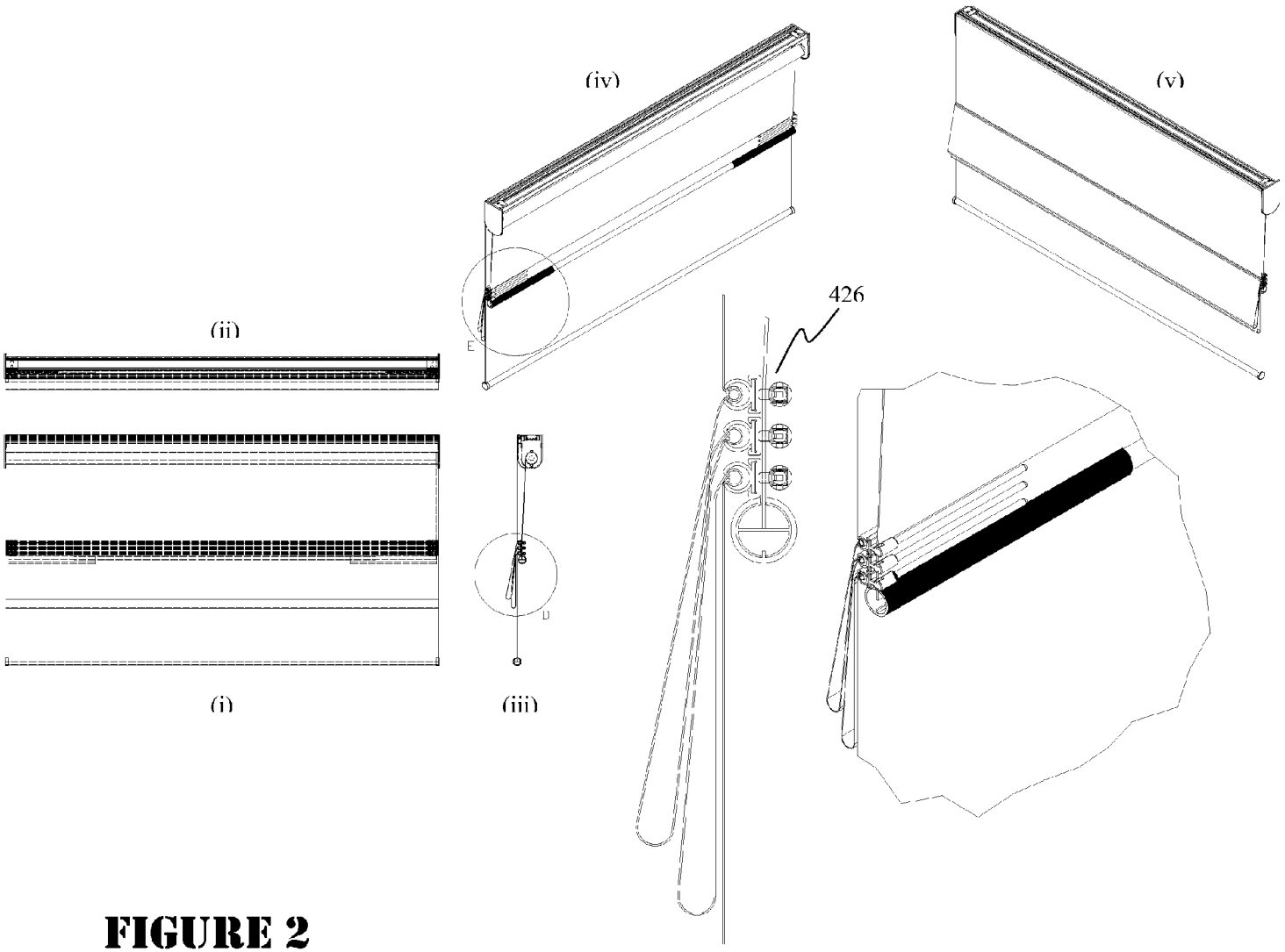
FIG. 2 shows the sliding tubes moved to the sides and engaging the auxiliary rods, allowing the rolling spool to retract the whole window curtain up, at the point of engagement.

Two sliding locking tubes 565 are placed around the outside surface of round tube 562, allowing the sliding motion of the tubes 565 to go from the two ends (shown as blackened pieces) in FIG. 2(*iv*) to the location towards the middle of the bottom beam 560 (shown as blackened pieces) in FIG. 1 (*iv*).

Figure 8:
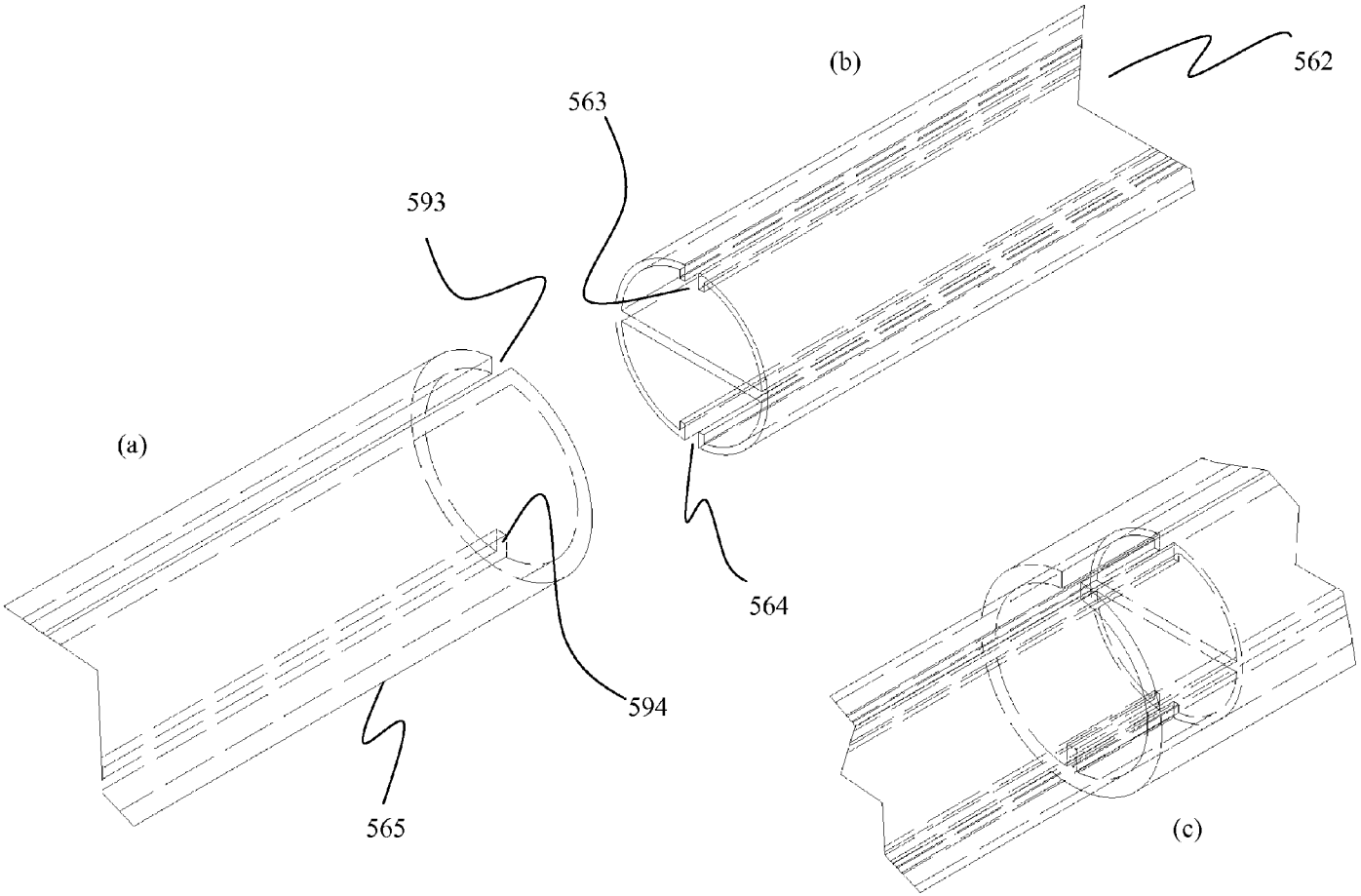
FIG. 8 shows the assembly parts of round tube and sliding tube. 8*a* shows the sliding tube, with an inside ridge shown by dotted line, which will be assembled into the bottom opening of round tube. Both round tube and sliding tube has congruent top openings, to accommodate the connection between the rigid piece to the lower end of rolling spool curtain, as shown in 8*c*.

The locking tubes 565, as shown in FIG. 8*a*, has a top opening 593 along the length of the tube body and an inside ridge 594 (shown as dotted line, since it is actually not visible when looking at it from the outside of the locking tube 565), so that locking tubes 565 are placed snugly on the outside of round tube 562.

FIG. 8*b* shows the round tube 562.

FIG. 8*c* shows locking tube 565 having been placed around the outside of round tube 562, with the inside ridge 594 slidably wedged into the bottom opening 565, allowing the sliding motion of locking tube 565 relative to the round tube 562.

The top opening 593 is aligned with the top opening 563 of the round tube 562, to accommodate the connection of rolling spool screen to the rigid piece 561 of the bottom beam 560.

When the locking tubes 565 are kept at the left and right extremities of the bottom beam 560, the rolling spool 50 will be able to roll up the fabric curtain 41 of the roman shade 40, at the point where the locking tubes 565 wedged into the gap 426 between the delineating rod 421 and auxiliary rod 425.

The size (referring to external diameter of locking tube 565) will be made to be bigger than the gap 426, so that when said locking tubes 565 are pushed to the left and right side extremities of the bottom beam 560, they will get wedged into gap 426, instead of going through the gap.

When the locking tubes 565 are slid towards the middle of the bottom beam 560, the rolling spool 50 and screen 52 can then move up and down, independent of the fabric curtain 41, due to the fact that the rolling spool 50 is "disengaged" from the fabric curtain 41 of the Roman shade.

Consequently, there will be the ability for the multi-step control of the location where the rolling spool screen 52 can be 'engaged' to the fabric screen 41, for purpose of controlling how much fabric curtain is left below the point of the bottom beam 560.

What is claimed is:

1. A Roman curtain comprising a Roman shade and a rolling spool curtain providing multi-step engagement between the Roman shade and the rolling spool curtain, the Roman curtain further comprising:

the Roman shade having the rolling spool curtain serving as the retracting and expanding control at the back side thereof, where fold lines on the Roman shade are formed by a delineating rod horizontally clipping a horizontal strip of fabric of the Roman shade to a double-pronged hook, which connects to an auxiliary rod that extends from either side of the Roman curtain and does not go the full horizontal width of the Roman curtain; and, a slidable locking mechanism at a bottom end of said rolling spool curtain wherein a round tube is wrapped around a horizontal rigid piece that forms a bottom beam of said rolling spool curtain, and two sliding tubes are placed outside a surface of said round tube, providing changeable engaging positions for the bottom beam of the rolling spool curtain to the fold lines of the Roman shade fabric, such that when the two sliding tubes are moved towards the center of the round tube, the bottom beam is allowed to be positioned to a desired pair of the auxiliary rods and then the sliding tubes may be moved towards two respective sides of said Roman curtain such that the sliding tubes engage respective ones of the pair of the auxiliary rods, for the purpose of adjusting how much of the Roman shade will be retracted up.

2. The Roman curtain of claim 1, wherein said bottom beam of the rolling spool curtain is made up of a horizontal rigid piece connecting to the bottom end of the rolling spool curtain and the round tube with a top opening and a bottom opening, whereby the top opening accommodates a connection from the bottom end of the rolling spool curtain to the rigid piece and the bottom opening to receive a ridge portion on the inside surface of the sliding tubes.

3. The Roman curtain of claim 2, wherein an external diameter size of the bottom beam is slightly smaller than a gap formed between the auxiliary rod and the delineating rod, and an external diameter size of the sliding tube is bigger than said gap.

4. The Roman curtain of claim 3, wherein the sliding tube has, along its length direction, a top opening to accommodate the connection between the bottom beam to the bottom end of the rolling spool curtain and the inside ridge for meshing into the bottom opening of the bottom tube.

* * * * *